US006109733A

United States Patent [19]

Raisanen et al.

[11] Patent Number: 6,109,733

[45] Date of Patent: Aug. 29, 2000

[54] PRINTHEAD FOR THERMAL INK JET DEVICES

[75] Inventors: Alan D. Raisanen, Sodus; Cathie J. Burke, Rochester, both of N.Y.

[73] Assignee: Xerox Corporation, Stamford, Conn.

[21] Appl. No.: 08/976,461

[22] Filed: Nov. 21, 1997

[51] Int. Cl.[7] ..... B41J 2/05

[52] U.S. Cl. ..... 347/63; 216/27

[58] Field of Search ..... 347/59, 63, 62; 216/27, 16

[56] References Cited

U.S. PATENT DOCUMENTS

| | | | |
|---|---|---|---|
| Re. 32,572 | 1/1988 | Hawkins et al. | 156/626 |
| 4,774,530 | 9/1988 | Hawkins | 346/140 R |
| 4,947,192 | 8/1990 | Hawkins et al. | 346/140 R |
| 4,951,063 | 8/1990 | Hawkins et al. | 346/1.1 |
| 5,030,971 | 7/1991 | Drake et al. | 346/140 R |
| 5,774,148 | 6/1998 | Cornell et al. | 347/59 |

*Primary Examiner*—Arthur T. Grimley
*Assistant Examiner*—Greg Moldafsky

[57] ABSTRACT

The efficiency of a thermal ink jet printhead is improved by providing a thermally grown field oxide layer and a deposited oxide layer, the two combined layers providing thermal insulation between a resistor layer and a silicon substrate. In a preferred embodiment, zirconium diboride is sputtered in the presence of oxygen to form a thin field oxide layer on a field oxide layer grown on the surface of the silicon substrate. At a predetermined time, during the sputtering process, oxygen is removed and the sputtering continues to form a conductive $ZrB_2$ layer. The combined thickness of the two oxide layers provides the required thermal isolation between silicon substrate and heater resistor while the thermally grown field oxide layer enables the closer packing of resistor transistor drive circuits.

5 Claims, 2 Drawing Sheets

PRINTHEAD FOR THERMAL INK JET DEVICES

BACKGROUND OF THE INVENTION AND MATERIAL DISCLOSURE STATEMENT

The invention relates generally to thermal ink jet printing and, more particularly, to thermal ink jet printheads with closer packing of transistor active circuits formed on the printhead.

Thermal ink jet printing is generally a drop-on-demand type of ink jet printing which uses thermal energy to produce a vapor bubble in an ink-filled channel that expels a droplet. A thermal energy generator or heating element, usually a resistor heater formed over a silicon substrate isolated therefrom by an underglaze layer. The resistor heater is located in the channels near the ink-ejecting nozzles a predetermined distance therefrom. An ink nucleation process is initiated by individually addressing resistors with short (1–10 $\mu$second) electrical pulses from transistor drive circuitry preferably located on the same chip to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

One problem with prior art printheads is that the underglaze layer must be thick enough to provide thermal insulation between the silicon substrate and the resistor heater to the extent necessary to divert most of the energy from the electrically addressed heaters into the ink where it forms a vapor bubble. If the energy is directed into the silicon substrate, it can cause temperature variations requiring compensation. The underglaze layer also acts as the field oxide layer in the electronically active components of the chip, providing electrical isolation between transistors in the driver and logic circuitry. U.S. Pat. Nos. 4,947,192 and 5,030,971 disclose ink jet printheads forming active drive matrices on resistor heater substrates which are electrically connected to a plurality of heater resistors. These patents are hereby incorporate by reference. For this purpose, the field oxide layer need be typically less than one-half the thickness required for thermal isolation. A thinner field oxide layer enables closer packing of transistor active areas on the chip.

While it is possible to decouple these two requirements (thermal and electrical isolation) by growing one oxide layer for transistor isolation and a separate oxide layer for heater thermal isolation, the extra mask level and high-temperature processing required adds additional cost to the printhead die.

SUMMARY OF THE INVENTION

It would be desirable to increase the packing density of transistor active areas on a printhead chip and to provide a field oxide layer optimized for electrical isolation of the transistor active areas.

It would also be desirable to improve the efficiency of the thermal isolation between a silicon substrate on which a resistor heater is formed and the resistive material layer.

The invention is directed to forming a field oxide layer over a silicon substrate, the field oxide layer grown to a thickness which optimizes electrical isolation of transistor active areas and which is approximately one-half of the thickness of a prior art underglaze layer. The resistive heater is formed on the field oxide layer by sputtering an electrically conductive compound, zirconium diboride ($ZrB_2$), in a preferred embodiment. The sputtering process includes the introduction of oxygen at a controlled rate at the beginning of the formation of the resistive heater layer. Introduction of the oxygen forms an insulating oxygen-doped zirconium diboride ($ZrB_2O_x$) film on top of the field oxide layer thermally grown on the silicon substrate. Once the oxidized zirconium diboride film has reached a sufficient thickness for optimum thermal isolation, the sputtering process continues without oxygen until the conductive heater resistor layer is grown to the thickness required for efficient thermal energy generation. The combined thickness of the field oxide layer and the $ZrB_2O_x$ layer provides the required thermal isolation of the resistor heater from the silicon substrate. The relatively thin thermally grown oxide layer enables closer packing of transistor drive circuitry.

More particularly, the invention relates to a thermal ink jet printhead, including:

a silicon substrate, a thermally grown field oxide layer formed on the surface of the silicon substrate, an array of heating resistors formed overlying the thermally grown field oxide layer, the heating resistors characterized by comprising a conductive layer of an electrically resistive compound of the general formula $(A)B_2$ where A is a metal from the group comprising zirconium, tantalum, tungsten, niobium, molybdenum, titanium, vanadium, and hafnium, and B is boron, and a second, deposited oxide layer formed overlying said thermally grown field oxide layer and underlying said conductive layer, whereby the thermally grown field oxide layer and the deposited oxide layer provide thermal insulation between the silicon substrate and the resistive heater The invention also relates to a method for fabricating an improved printhead for use in an ink jet printer, the printhead including a plurality of ink filled channels in thermal communication with at least one section of a heated resistor, comprising the steps of:

(a) forming a silicon substrate, (b) growing a thermal field oxide layer on the silicon substrate surface, (c) sputtering a layer of resistive material of the general formula $(A)B_2$ on the surface of the field oxide layer in the presence of oxygen to form an oxide layer of relatively high sheet resistance, where A is a metal from the group comprising zirconium, tantalum, tungsten, niobium, molybdenum, titanium, vanadium, and hafnium, and B is boron, (d) continuing the sputtering of the resistive material of step (c) in the absence of oxygen to form an electrically conductive resistive layer, (e) forming electrical contacts and drive circuits as interconnects to said resistive layer and (f) forming a plurality of ink channels filled with ink in thermal communication with said resistive layers

DESCRIPTION OF THE INVENTION

Figure 1:
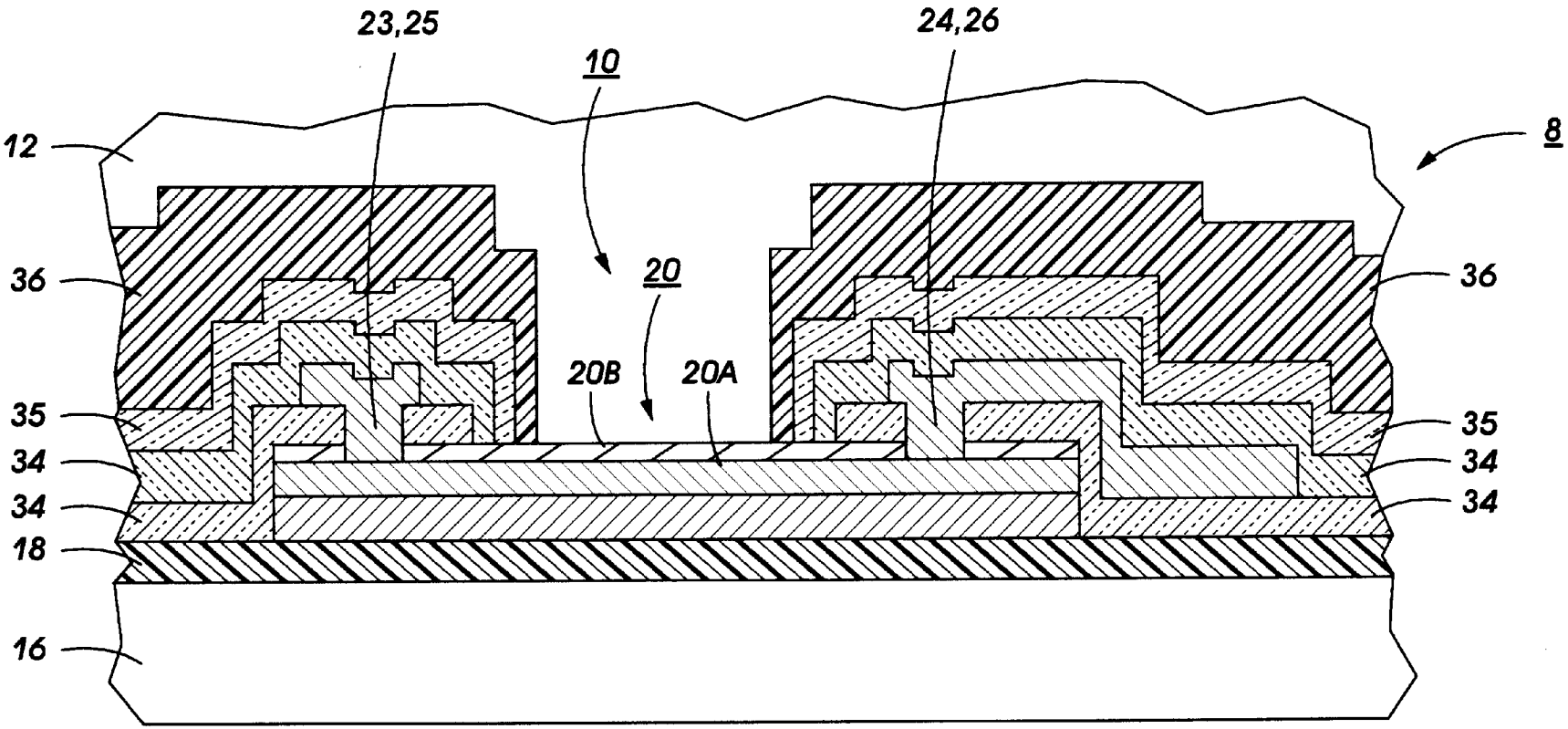
FIG. 1 is a cross-sectional view of a first embodiment of the improved heater resistor of the present invention.

FIG. 1 is a cross-sectional view of a first embodiment of an improved resistive heater structure which can be used, for example, in a printhead of the type disclosed in U.S. Pat. Nos. Re. 32,572, 4,774,530 and 4,951,063, whose contents are hereby incorporated by reference. It is understood that the improved heater structures of the present invention can be used in other types of thermal ink jet printheads where a resistive element is heated to nucleate ink in an adjoining layer.

Referring to FIG. 1, the heater substrate portion of an ink jet printhead 8 is shown with ink in channel 10 being ejected from nozzle 12 formed in the front face. Printhead 8 is fabricated by a conventional process (except for the formation of the heater resistor) by bonding together channel and heater plates as disclosed in U.S. Pat. Nos. Re. 32,572 and 4,951,063, referenced supra. A silicon substrate 16 has an underglaze layer formed on its surface comprising a thermally grown field oxide layer 18. Heater resistors 20 are formed on the surface of layer 18 and comprise a deposited oxide layer 20A and a conductive layer 20B of an electrically resistive compound. In a preferred embodiment, zirconium diboride ($ZrB_2$) is sputtered onto the surface of layer 18 while adding oxygen to the sputtering chamber to produce oxidized layer 20A. Layer 20A has a sheet resistance exceeding 7000 ohms/square. Once layer 20A is at a predetermined thickness, the oxygen flow is terminated and the sputtering process continues to form conductive layer 20B as the active heater resistor element. Layer 20B is highly conductive with a sheet resistance of about 10 ohms/square. Layers 20A and 20B are thus patterned and etched at the same time eliminating additional masking steps.

In a preferred embodiment, layer 18 is 7500 § and layer 20A is 7500 §. The combined thickness of the two layers is 1.5 $\mu$ which is the thickness of the conventional single oxide layer grown on a silicon substrate 16; e.g., layer 20A replaces a portion of a prior art layer 18. Thus, combined layers 18 and 20A provide thermal isolation between the silicon substrate 16 and layer 20B while layer 18, much thinner than the prior art layer, provides electrical insulation between transistor drive circuits. Since transistor spacing is a function of the oxide layer 18 thickness, the thinner layer 18 permits closer packing of transistor active areas of the type shown, for example, in U.S. Pat. Nos. 4,947,192 and 5,030,971, referenced supra. As disclosed in these patents, a field oxide is typically grown on a silicon substrate by means of a LOCOS process or variation thereof. Active areas of transistors are delineated by a nitride masking process. When the field oxide is grown, some oxide encroaches under the edges of the mask, resulting in a thinned-out region of the field oxide known in the industry as the "bird's beak". The minimum distance between two active transistor areas is determined by the extent of the bird's beak, which varies in proportion to the thickness of the field oxide. Two transistors cannot be placed in proximity closer than twice the extent of the bird's beak; thus, if the thickness of the field oxide can be reduced by half, the minimum distance between transistors can also be halved, and the packing density may be increased, reducing the cost of the chip.

Figure 2:
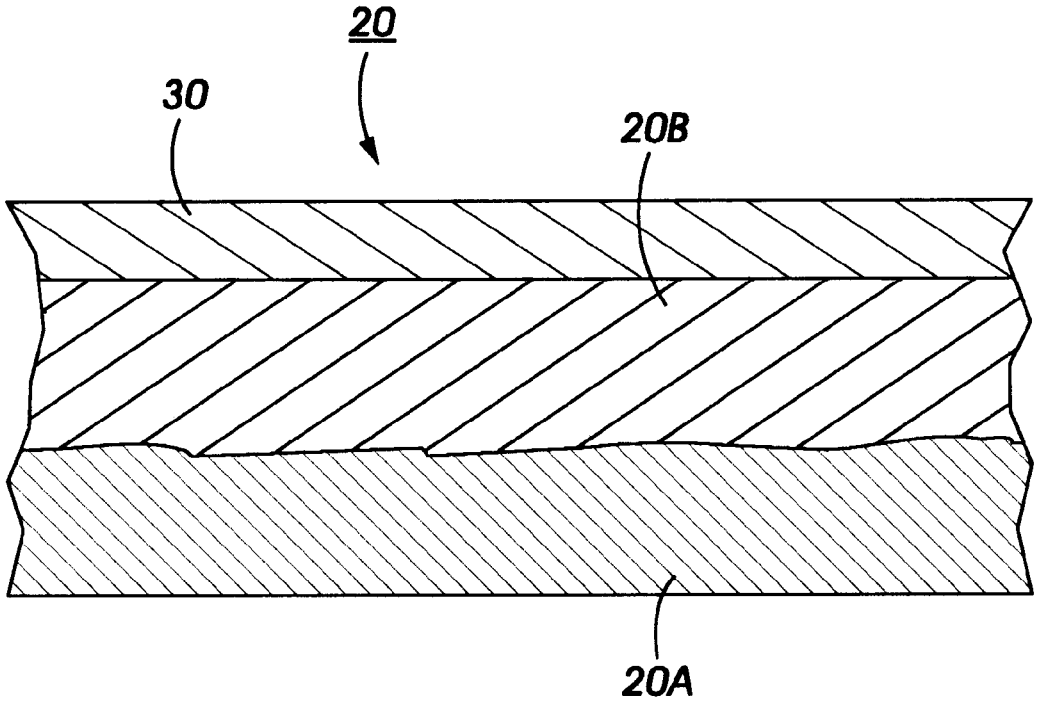
FIG. 2 is a further enlarged cross-sectional view of the resistor of FIG. 1.

Continuing with this description, layer 20B is masked and etched to define the heater active areas. A glass layer 34 is deposited and contact holes are etched in it to produce vias 23, 24 at the edges of the resistor, and heater opening 20 in the center of the resistor. A dielectric layer 30 is formed over layer 20B to electrically isolate the heater resistor from the ink, and a tantalum layer (not shown) is deposited to provide corrosion protection of the heater from the ink. Both dielectric layer 30 and the tantalum layer are etched to leave the protective layers only over the heater opening 20. An aluminum layer is deposited and etched to form addressing electrode 25 and aluminum counter return electrode 26. For electrode passivation, a glass film 34 is deposited, followed by a second glass and/or nitride passivation layer 35 and a thick film insulative layer 36. Layer 36 is polyimide in a preferred embodiment. Films 34 and 36 are formed as described in the '063 patent referenced supra, Referring to FIG. 2, the $ZrB_2O_x$ layer 20A is shown as underlying the $ZrB_2$ layer 20B. Other materials which are suitable for layer 20B are metal diborides, with metals from the group comprising zirconium, tantalum, tungsten, niobium, molybdenum, titanium, vanadium, and hafnium.

While the embodiment disclosed herein is preferred, it will be appreciated from this teaching that various alternative, modifications, variations or improvements therein may be made by those skilled in the art. All such modifications are intended to be encompassed by the following claims:

What is claimed is:

1. A thermal ink jet printhead, including:

a silicon substrate, a thermally grown field oxide layer formed on the surface of the silicon substrate, an array of heating resistors formed overlying the thermally grown field oxide layer, the heating resistors comprising a conductive layer of an electrically resistive compound of the general formula (A)B2 where A is a metal from the group consisting of zirconium, tantalum, tungsten, niobium, molybdenum, titanium, vanadium, and hafnium, and B is boron, and a deposited oxide layer formed overlying said thermally grown field oxide layer and underlying said conductive layer, the oxide layer comprising said general formula and oxygen, whereby the thermally grown field oxide layer and the deposited oxide layer provide thermal insulation between the silicon substrate and the conductive layers of the heating resistors.

2. The printhead of claim 1 wherein A is zirconium.

3. The printhead of claim 1 further including transistor drive circuits electrically connected to said array of heating resistors, and whereby the thermally grown field oxide layer provides electrical insulation between said transistor drive circuits.

4. A method for fabricating a printhead for use in an ink jet printer, the printhead including a plurality of ink filled channels in thermal communication with at least one section of a heated resistor, comprising the steps of:

(a) forming a silicon substrate, (b) growing a thermal field oxide layer on the silicon substrate surface, (c) sputtering a layer of resistive material of the general formula (A)B2 on the surface of the field oxide layer in the presence of oxygen to form an oxide layer of relatively high sheet resistance, where A is a metal from the group consisting of zirconium, tantalum, tungsten, niobium, molybdenum, titanium, vanadium, and hafnium, and B is boron, (d) continuing the sputtering of the resistive material of step (c) in the absence of oxygen to form an electrically conductive resistive layer, (e) forming electrical contacts and drive circuits as interconnects to said resistive layer and (f) forming a plurality of ink channels filled with ink in thermal communication with said oxide layer of relatively high sheet resistance and said resistive layer.

5. The method of claim 4 wherein the resistive material is zirconium diboride.

* * * * *